US005459476A

United States Patent [19]

Hsieh

[11] Patent Number: 5,459,476

[45] Date of Patent: Oct. 17, 1995

[54] ANTENNA PROTECTING DEVICE FOR A MOTOR VEHICLE

[76] Inventor: Wu-Hsiung Hsieh, P.O. Box 82-144, Taipei, Taiwan

[21] Appl. No.: 390,127

[22] Filed: Feb. 17, 1995

[51] Int. Cl.[6] ..... H01Q 3/02

[52] U.S. Cl. ..... 343/882; 343/715; 343/888; 343/900; 343/904; 248/289.31; 248/900

[58] Field of Search ..... 343/713, 715, 343/720, 878, 880, 882, 888, 892, 894, 900, 904, DIG. 1; H01Q 7/08, 7/12, 1/22, 3/02

[56] References Cited

U.S. PATENT DOCUMENTS

| | | | |
|---|---|---|---|
| 2,186,934 | 7/1940 | Palmer | 343/900 |
| 2,950,836 | 8/1960 | Murducic | 248/538 |
| 3,138,661 | 6/1964 | Grashow | 343/888 |
| 3,625,553 | 12/1971 | Mattioli et al. | 248/900 |
| 3,886,560 | 5/1975 | Mortensen et al. | 343/882 |
| 3,889,915 | 6/1975 | Hashiguchi et al. | 248/900 |
| 5,099,251 | 3/1992 | Fisher | 343/715 |

FOREIGN PATENT DOCUMENTS

| | | | |
|---|---|---|---|
| 0100003 | 5/1986 | Japan | H01Q 1/22 |

*Primary Examiner*—Michael C. Wimer
*Assistant Examiner*—Tho G. Phan
*Attorney, Agent, or Firm*—Alfred Lei

[57] ABSTRACT

An antenna protecting device for motor vehicles including a triangular base having a cavity at an inner bottom thereof, a spherical container having a neck portion rotatably connected with the triangular base and provided at a bottom with a spring-loaded ball, a bracket extending upwardly from the spherical container and having a platform at an upper end, a hemispherical seat engaged with a lower portion of the spherical container and having an orifice which is smaller than the ball in diameter, a protective rod partly inserted in the spherical container through the bracket, and an antenna connected with the platform of the bracket.

1 Claim, 4 Drawing Sheets

ANTENNA PROTECTING DEVICE FOR A MOTOR VEHICLE

BACKGROUND OF THE INVENTION

This invention is directed to a device for protecting an antenna of a motor vehicle from being damaged when meeting with an obstacle.

It has been found that the conventional antenna for motor vehicles is provided with no protective means thereby rendering it easily damaged when meeting with an obstacle such as trees, signs, or the like.

Therefore, it is an object of the present invention to provide a protecting device which can effectively prevent the antenna from being damaged.

SUMMARY OF THE INVENTION

This invention relates to an antenna protecting device for motor vehicles.

It is the primary object of the present invention to provide an antenna protecting device which can prevent the antenna from being damaged.

It is another object of the present invention to provide an antenna protecting device which is simple in construction.

It is still another object of the present invention to provide an antenna protecting device which is low in cost.

It is still another object of the present invention to provide an antenna protecting device which is fit for practical use.

It is a further object of the present invention to provide an antenna protecting device which is economic to produce.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
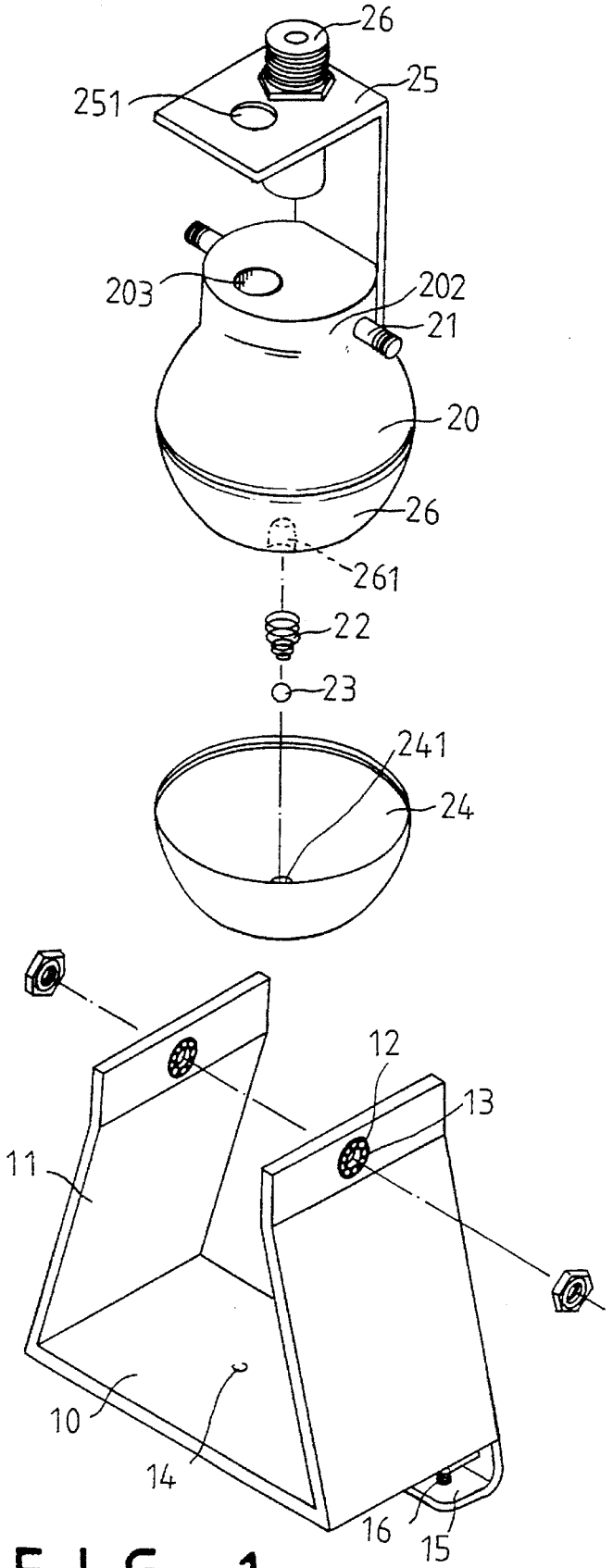
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
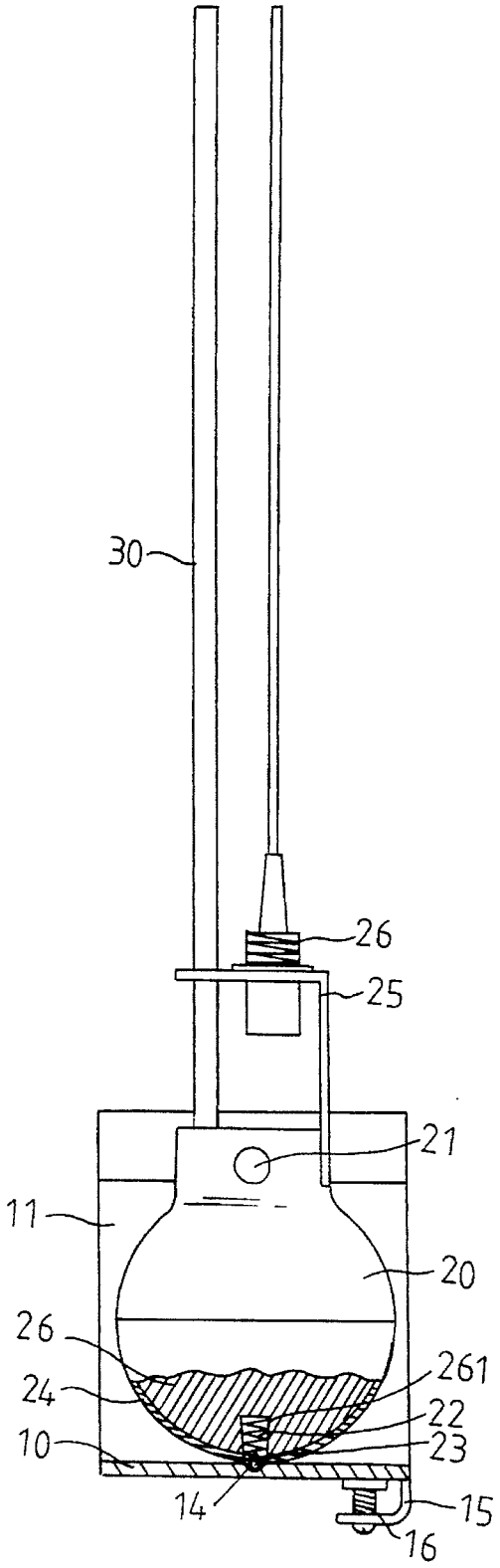
FIG. 2 is a sectional view of the present invention.
Figure 4:
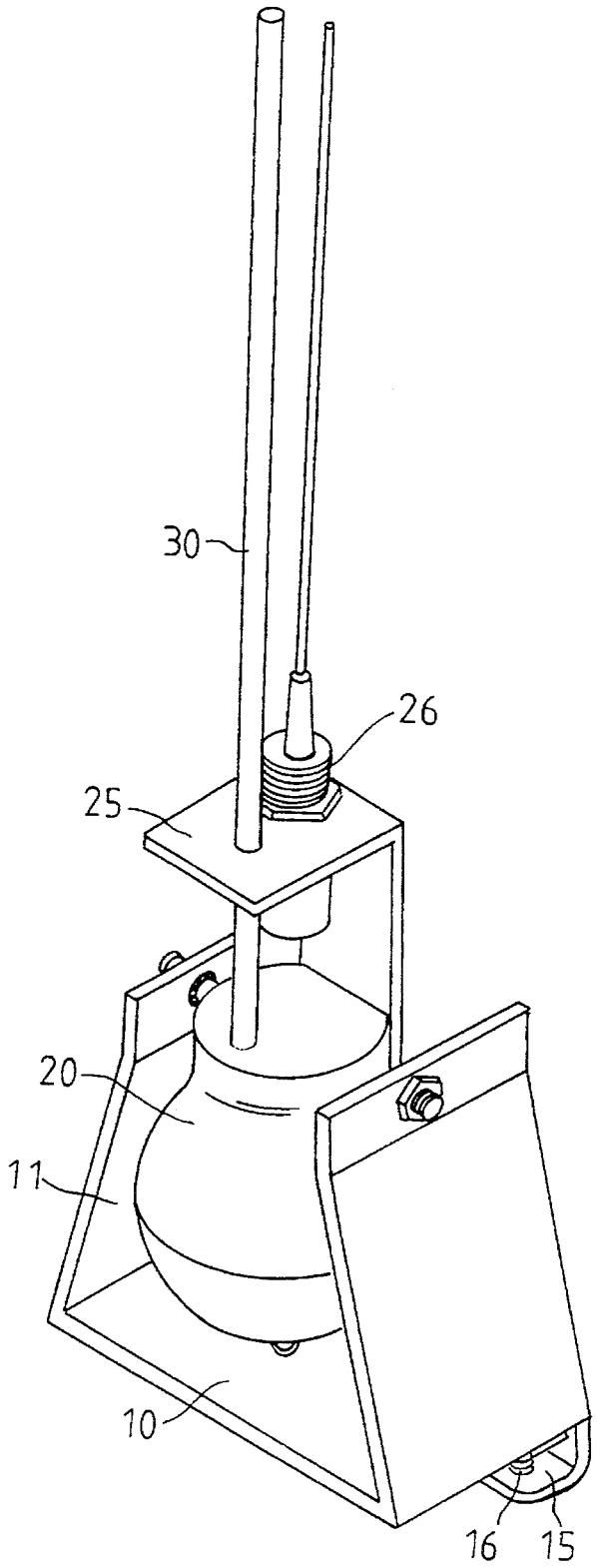
FIG. 4 is a perspective view of the present invention.

With reference to the drawings and in particular to FIGS. 1, 2 and 4 thereof, the antenna protecting device for motor vehicles according to the present invention mainly comprises a triangular base 10, a spherical container 20, and a protective rod 30.

As illustrated, the triangular base 10 has two upwardly extending sides 11 the upper edges of which are separated by a gap and formed with a hole 12 in which is fitted a bearing 13. Further, the inner bottom of the triangular base 10 has a cavity 14 at the center, while the outer bottom is provided with a mounting 15 engaged with two screws 16 (only one is shown in the figures) so that the triangular base 10 can be conveniently fixed on any desired position of a motor vehicle.

The spherical container 20 is provided with two opposite rod members 21 at the neck 202 portion which are adapted to the bearing 13 of the triangular base 10 so that the spherical container 20 can be freely swung with respect to the triangular base 10. Further, the spherical container 20 is formed at the top with an opening 203 and at the center of the bottom with a conical recess 261 in which are fitted a conical spring 22 and a ball 23. A hemispherical seat 24 is threadedly engaged or otherwise secured to the bottom of the spherical container 20 and has an orifice 241 at the center. The orifice 241 is smaller than the ball 23 in diameter so that the ball 23 will partly go out of the orifice 241. A bracket 25 extends upwardly from the spherical container 20 and has a platform having a hole 251 and a threaded connector 26. The threaded connector 26 is used to engage with an antenna (shown but not numbered).

The protective rod 30 is partly inserted in the spherical container 20 through the opening 203.

Figure 3:
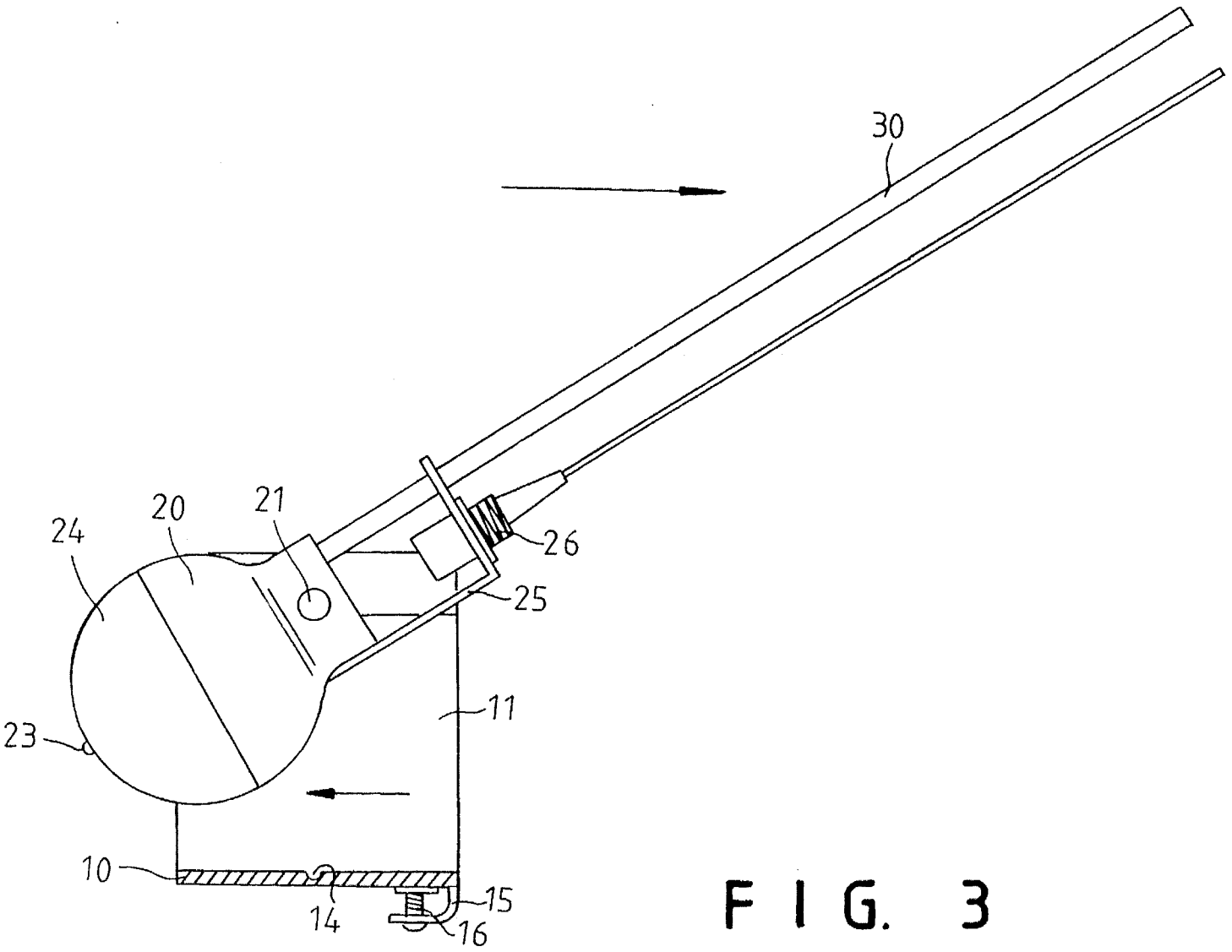
FIG. 3 is a working view of the present invention.

Looking now at FIG. 3, when the protective rod 30 meets with an obstacle (not shown) thereby rotating in clockwise direction, the spherical container 20 will be pushed to rotate with respect to the rod members 21 in clockwise too. As the protective rod 30 is no longer blocked by the obstacle, the spherical container 20 will return to its original upright position due to gravitational force. In the meantime, the ball 23 will be engaged with the recess 14 thereby further keeping the spherical container 20 in position.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An antenna protecting device for motor vehicles comprising:

a triangular base having a cavity at an inner bottom thereof;

a spherical container having a neck portion rotatably connected with said triangular base and provided at a bottom with a spring-loaded ball;

a bracket extending upwardly from said spherical container and having a platform at an upper end;

a hemispherical seat engaged with a lower portion of said spherical container and having an orifice which is smaller than said ball in diameter;

a protective rod partly inserted in said spherical container through said bracket; and an antenna connected with the platform of said bracket.

* * * * *